US007564431B2

(12) United States Patent
Lin et al.

(10) Patent No.: US 7,564,431 B2
(45) Date of Patent: Jul. 21, 2009

(54) METHOD FOR REDUCING POWER CONSUMPTION OF PLASMA DISPLAY PANEL

(75) Inventors: Chi-Hsiu Lin, Yun-Lin Hsien (TW); Han-Yu Chao, Tainan Hsien (TW)

(73) Assignee: Chunghwa Picture Tubes, Ltd., Taipei City (TW)

( * ) Notice: Subject to any disclaimer, the term of this patent is extended or adjusted under 35 U.S.C. 154(b) by 605 days.

(21) Appl. No.: 11/161,720

(22) Filed: Aug. 15, 2005

(65) Prior Publication Data

US 2007/0035479 A1 Feb. 15, 2007

(51) Int. Cl.
*G09G 3/28* (2006.01)

(52) U.S. Cl. ..... 345/68

(58) Field of Classification Search ..... None
See application file for complete search history.

(56) References Cited

U.S. PATENT DOCUMENTS 6,459,210 B1 10/2002 Schoenbauer et al.
6,646,387 B2 11/2003 Chae
6,774,576 B2 8/2004 Schoenbauer et al.
7,379,033 B2 * 5/2008 Lee et al. ..... 345/60
2001/0033257 A1 10/2001 Shin
2002/0030642 A1 3/2002 Huang
2005/0078107 A1 * 4/2005 Lee et al. ..... 345/211

FOREIGN PATENT DOCUMENTS

JP 2003-076321 A 3/2003
KR 20030003573 1/2003
TW 516015 1/2003
TW 530281 5/2003

* cited by examiner

*Primary Examiner*—Sumati Lefkowitz
*Assistant Examiner*—Tammy Pham
(74) *Attorney, Agent, or Firm*—Winston Hsu

(57) ABSTRACT

A method for recovering electric energy of a plasma display panel (PDP) by controlling two recovery units respectively connected to two sides of the PDP is introduced. The method includes forming series resonance loops within corresponding periods of a working period so that a capacitor of one of the two recovery units is charging twice, where it is charged once by the PDP and is also charged by another capacitor of the other one recovery unit; and controlling the two capacitors of the two recovery units to respectively charge the PDP within proper periods.

6 Claims, 8 Drawing Sheets

METHOD FOR REDUCING POWER CONSUMPTION OF PLASMA DISPLAY PANEL

BACKGROUND OF THE INVENTION

1. Field of the Invention

The present invention relates to a method for reducing power consumption of a plasma display panel (PDP), and more particularly, to a method for improving efficiency of power recovery of a PDP.

2. Description of the Prior Art

Plasma display panels are thin panels that can display over a large screen. Therefore, they are rapidly gaining popularity in the new large-panel market. The working principle of a plasma display panel (PDP) is to excite electric charges in the plasma by charging the PDP with a high frequency alternating voltage. In the activating process, ultraviolet rays are emitted to excite the phosphor on the tube wall for emitting light. The plasma display panel behaves like a capacitor. When two electrodes of the PDP are suddenly short-circuited or charged by the high voltage, an inrush current will be generated which will induce a great loss of energy. This is a problem which the driving circuit of the plasma display panel must rectify. In order to reduce the inrush current, the sustain driver of a traditional plasma display panel uses an energy recovery circuit (ERC) that has an inductor resonating with the intrinsic capacitor of the PDP to reduce power consumption.

Please refer to FIG. 1, which is a circuit diagram of an energy recovery circuit of a sustain driver of a plasma display panel (PDP) 10 according to the prior art. The energy recovery circuit has a first driver 20 and a second driver 30 respectively connected to two sides of the PDP 10 to provide the sustain voltage Vs to the PDP 10. The PDP 10 is represented as a panel capacitor Cp in FIG. 1. The first driver 20 has a first driving unit 22 and a first recovery unit 24. The first driving unit 22 has two switches SW1 and SW2. The first recovery unit 24 has two diodes (D1, D2), two switches (SW5, SW6), a first inductor Lx, and a first recovery capacitor Cx. One end of the switch SW1 is connected to a first bias terminal Vs, and the other end of the switch SW1 is connected to the first inductor Lx, the switch SW2, and the left electrode of the panel capacitor Cp. The switch SW2 and the first recovery capacitor Cx are connected to the ground terminal GND, i.e. the second bias terminal. The other end of the first recovery capacitor Cx is connected the switches SW5 and SW6. The switch SW5 is connected to the diode D1 in series and then to the first recovery capacitor Cx, the first inductor Lx, and the diode D2. The diode D2 is connected to the switch SW6 in series and then to the first recovery capacitor Cx, the first inductor Lx, and the diode D1. The second driver 30 has a circuit structure that is symmetric with the first driver 20. The second driver 30 has a second driving unit 32 and a second recovery unit 34. The second driving unit 32 has two switches SW3 and SW4. The second recovery 34 has two diodes (D3, D4), two switches (SW7, SW8), a second inductor Ly, and a second recovery capacitor Cy.

Please refer to FIGS. 1-2. FIG. 2 is a timing diagram of control signals used to control the first control circuit 20 and the second control circuit 30 within a working period of the PDP according to the prior art. Within the period $t_3$-$t_4$, the stored energy of the panel capacitor Cp is transferred to the second recovery unit 34, and the second driving unit 32 drives the voltage Vy on the right electrode of the panel capacitor Cp from Vs to the ground level. The switches SW1 and SW8 are turned on to form a series resonance loop $l_1$ that passes through the panel capacitor Cp, the second inductor Ly, the diode D4, and the second recovery capacitor Cy so that the second recovery capacitor Cy is charged by the panel capacitor Cp. In an ideal condition, before turning on the SW4, due to the resonance loop $l_1$, the voltage level of the second recovery capacitor Cy should be pulled up to Vs/2 and the voltage Vy should be pulled down to the ground level. However, because of high-frequency capacitance effect, inductance effect, and resistance effect, the voltage level of the second recovery capacitor Cy is pulled up to (Vs/2−ΔV1) and the voltage Vy is actually pulled down to ΔV2, where both ΔV1 and ΔV2 are positive voltages and ΔV1 is less than Vs/2. Therefore, when the switch SW4 is turned on to make the right electrode of the panel capacitor Cp connect to the ground terminal GND, the voltage Vy is pulled down from ΔV2 to the ground level. The electric energy, hence, is wasted while the right electrode of the panel 10 is connected to the ground terminal GND.

Please refer to FIGS. 2-3. FIG. 3 indicates the status of the drivers 20 and 30 within the period $t_5$-$t_7$. Within the period $t_5$-$t_7$, energy stored in the second recovery capacitor Cy within the period $t_3$-$t_4$ is recovered to the panel capacitor Cp so that voltage Vy of the right electrode of the panel 10 is pulled up from the ground level. The switches SW1 and SW2 are turned on to form a series resonance loop $l_2$ that passes through the second recovery capacitor Ly, the diode D3, the second inductor Ly, and the panel capacitor Cp so that the panel capacitor Cp is charged by the second recovery circuit Cy. In the ideal condition, the voltage Vy should be pulled up to the sustain voltage Vs. However, because of the high-frequency capacitance effect, the inductance effect, and the resistance effect, the voltage Vy is actually pulled up to approximately (Vs−2ΔV1). Therefore, after the time $t_7$ when the switch SW3 is turned on, the voltage Vy is pulled up from (Vs−2ΔV1) to Vs. The electric energy, hence, is wasted while the right electrode of the panel 10 is connected to the first bias terminal Vs.

Please refer to FIGS. 2 and 4. FIG. 4 indicates the status of the drivers 20 and 30 within the period $t_7$-$t_8$. Within the period $t_7$-$t_8$, the stored energy of the panel capacitor Cp is transferred to the first recovery unit 24, and the first driving unit 22 drives the voltage Vy on the left electrode of the panel capacitor Cp from Vs. The switches SW3 and SW6 are turned on to form a series resonance loop $l_3$ that passes through the panel capacitor Cp, the first inductor Lx, the diode D2, and the first recovery capacitor Cx so that the second first capacitor Cx is charged by the panel capacitor Cp. In the ideal condition, before turning on the SW2, the voltage level of the first recovery capacitor Cx should be pulled up to Vs/2 and the voltage Vx should be pulled down to the ground level. However, due to the high-frequency capacitance effect, the inductance effect, and the resistance effect, the voltage level of the first recovery capacitor Cx is pulled up to (Vs/2−ΔV1) and the voltage Vy is actually pulled down to ΔV2. Therefore, when the switch SW2 is turned on to make the left electrode of the panel capacitor Cp connect to the ground terminal GND, the voltage Vx is pulled down from ΔV2 to the ground level. The electric energy, hence, is wasted while the left electrode of the panel 10 is connected to the ground terminal GND.

Please refer to FIGS. 2 and 5. FIG. 5 indicates the status of the drivers 20 and 30 within the period $t_1$-$t_3$. Within the period $t_1$-$t_3$, energy stored in the first recovery capacitor Cx within the period $t_7$-$t_8$ of previous working period is recovered to the panel capacitor Cp so that voltage Vx of the left electrode of the panel 10 is pulled up from the ground level. The switches SW3 and SW5 are turned on to form a series resonance loop $l_4$ that passes through the first recovery capacitor Lx, the diode D1, the first inductor Lx, and the panel capacitor Cp so that the panel capacitor Cp is charged by the first recovery circuit Cx. In the ideal condition, the voltage Vx should be pulled up to Vs. However, because of the high-frequency capacitance effect, the inductance effect, and the resistance effect, the voltage Vx is actually pulled up to approximately (Vs−2ΔV1). Therefore, after the time $t_3$ when the switch SW1 is turned on, the voltage Vx is pulled up from (Vs−2ΔV1) to Vs. The electric energy, hence, is wasted while the left electrode of the panel 10 is connected to the first bias terminal Vs.

Briefly summarized, due to high-frequency capacitance effect, inductance effect, and resistance effect, the prior art method fails to achieve zero-voltage switching (ZVS) when adjusting the voltage Vx and Vy to Vs or to the ground level before the corresponding electrode connecting to the first bias terminal Vs or to the ground terminal GND.

SUMMARY OF THE INVENTION

It is therefore a primary objective of the claimed invention to provide a method for reducing power consumption of a plasma display panel (PDP) to solve the above-mentioned problem.

The method comprises controlling a first recovery capacitor to charge a second recovery capacitor through a panel of the PDP within a first period; controlling the panel to charge the second recovery capacitor within a second period; controlling the second recovery capacitor to charge the first recovery capacitor through the panel of the PDP within a third period; and controlling the panel to charge the first recovery capacitor within a fourth period.

These and other objectives of the present invention will no doubt become obvious to those of ordinary skill in the art after reading the following detailed description of the preferred embodiment that is illustrated in the various figures and drawings.

DETAILED DESCRIPTION

Figure 6:
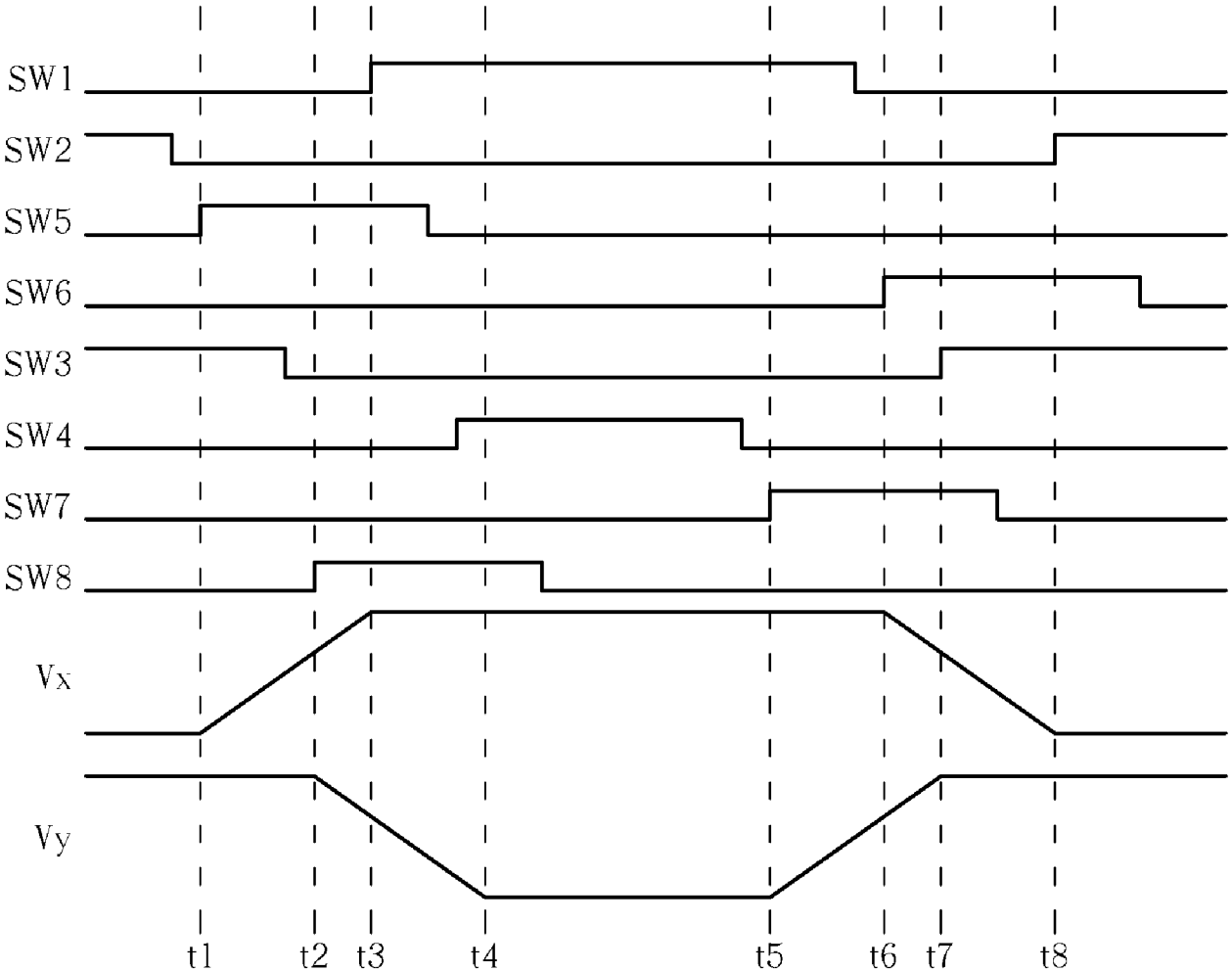
FIG. 6 is a timing diagram of control signals used to control the first control circuit and the second control circuit shown in FIG. 1 according to the present invention.
Figure 7:
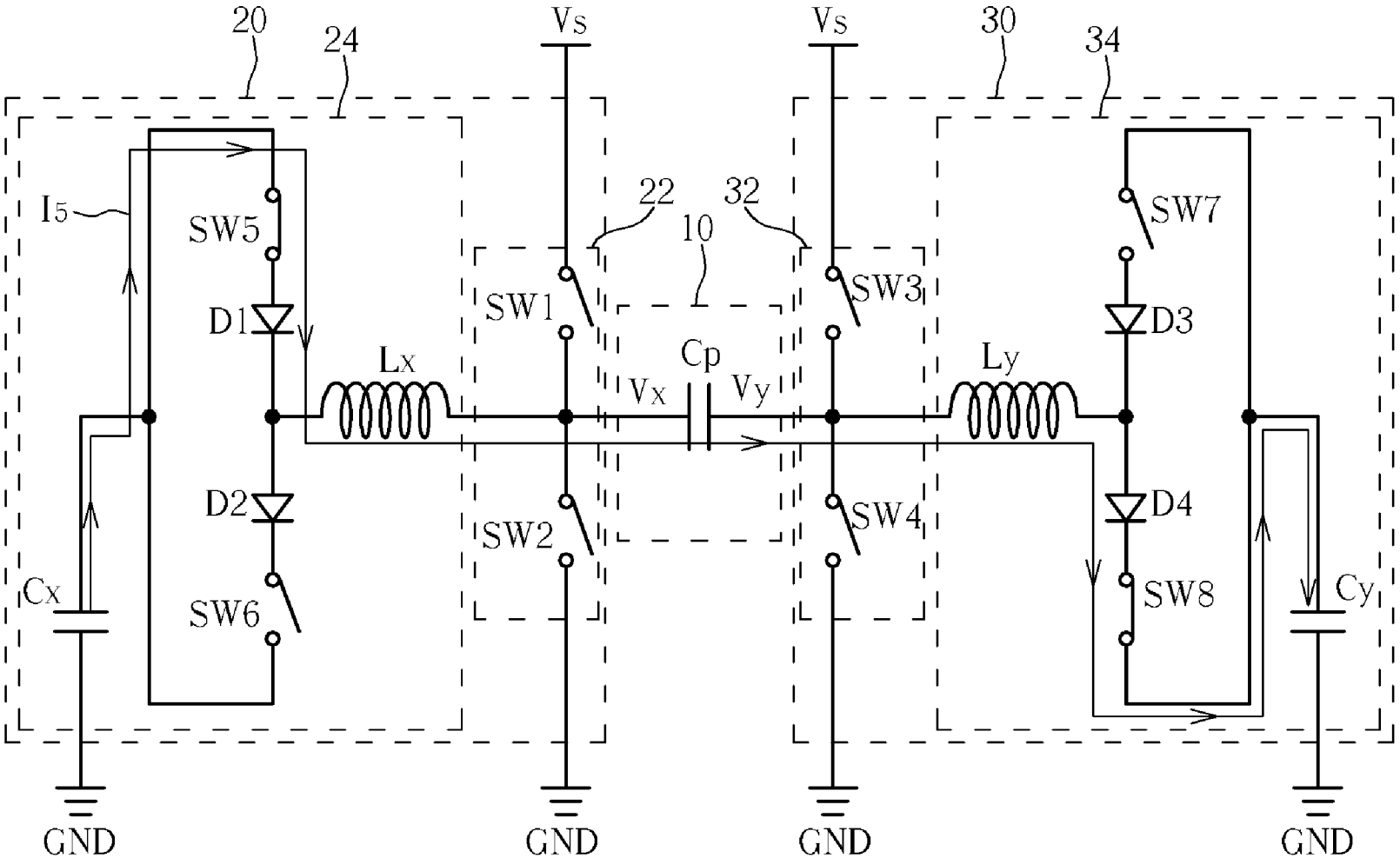
FIG. 7 indicates the status of the drivers shown in FIG. 1 within the period $t_2$-$t_3$ shown in FIG. 6.
Figure 8:
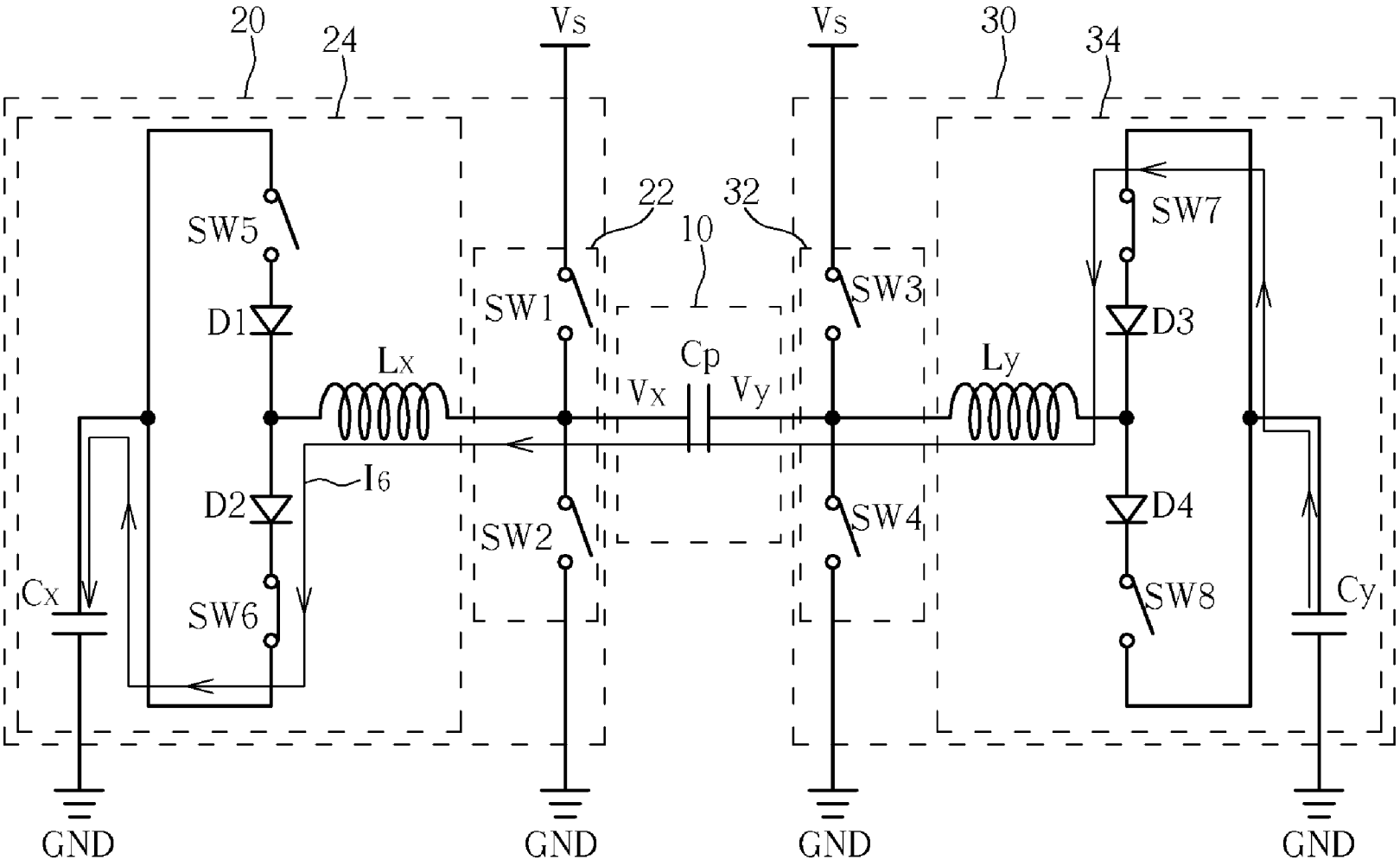
FIG. 8 indicates the status of the drivers shown in FIG. 1 within the period $t_6$-$t_7$ shown in FIG. 6.

Please refer to FIGS. 2 and 6-8. FIG. 6 is a timing diagram of control signals used to control the first control circuit and the second control circuit shown in FIG. 1 according to the present invention. FIG. 7 indicates the status of the drivers 20 and 30 shown in FIG. 1 within the period $t_2$-$t_3$ shown in FIG. 6. FIG. 8 indicates the status of the drivers 20 and 30 shown in FIG. 1 within the period $t_6$-$t_7$ shown in FIG. 6. The major difference between the present invention and the prior art is that both the recovery capacitors Cx and Cy are respectively charging twice within a working period of the PDP.

Figure 1:
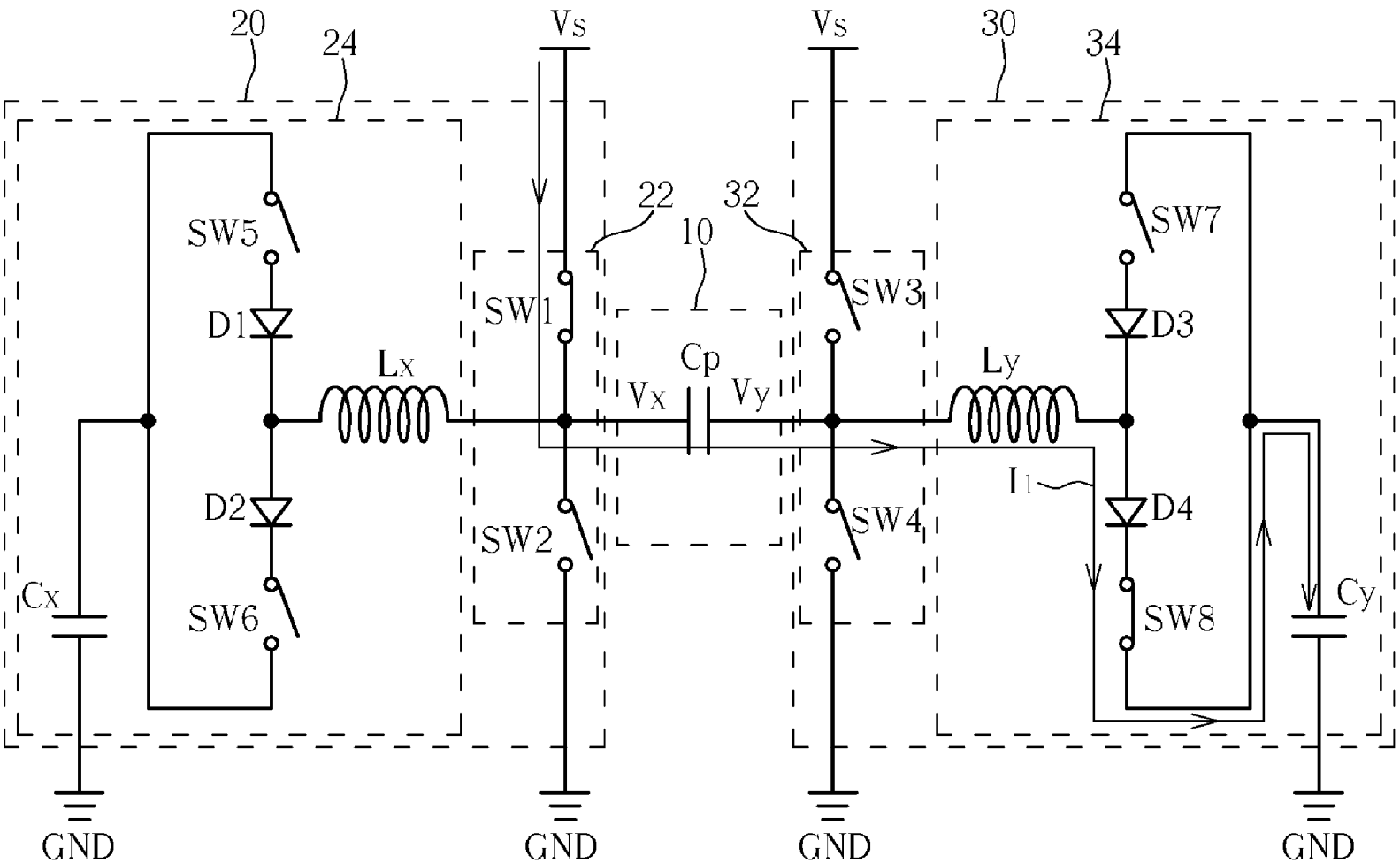
Fig. 1 Prior art
FIG. 1 is a circuit diagram of an energy recovery circuit of a plasma display panel according to the prior art.
Figure 2:
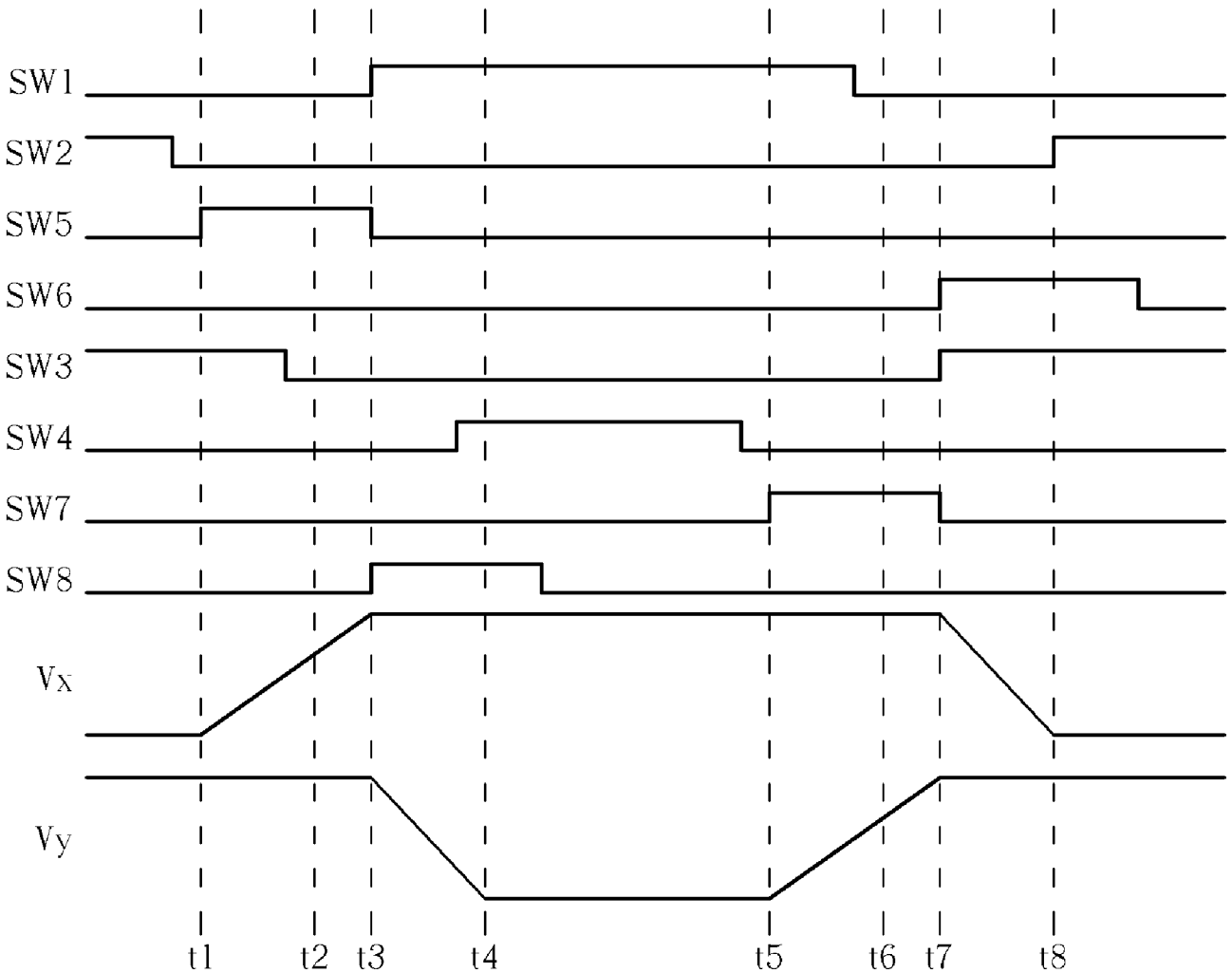
Fig. 2 Prior art
FIG. 2 is a timing diagram of control signals used to control the first control circuit and the second control circuit shown in FIG. 1 according to the prior art.
Figure 3:
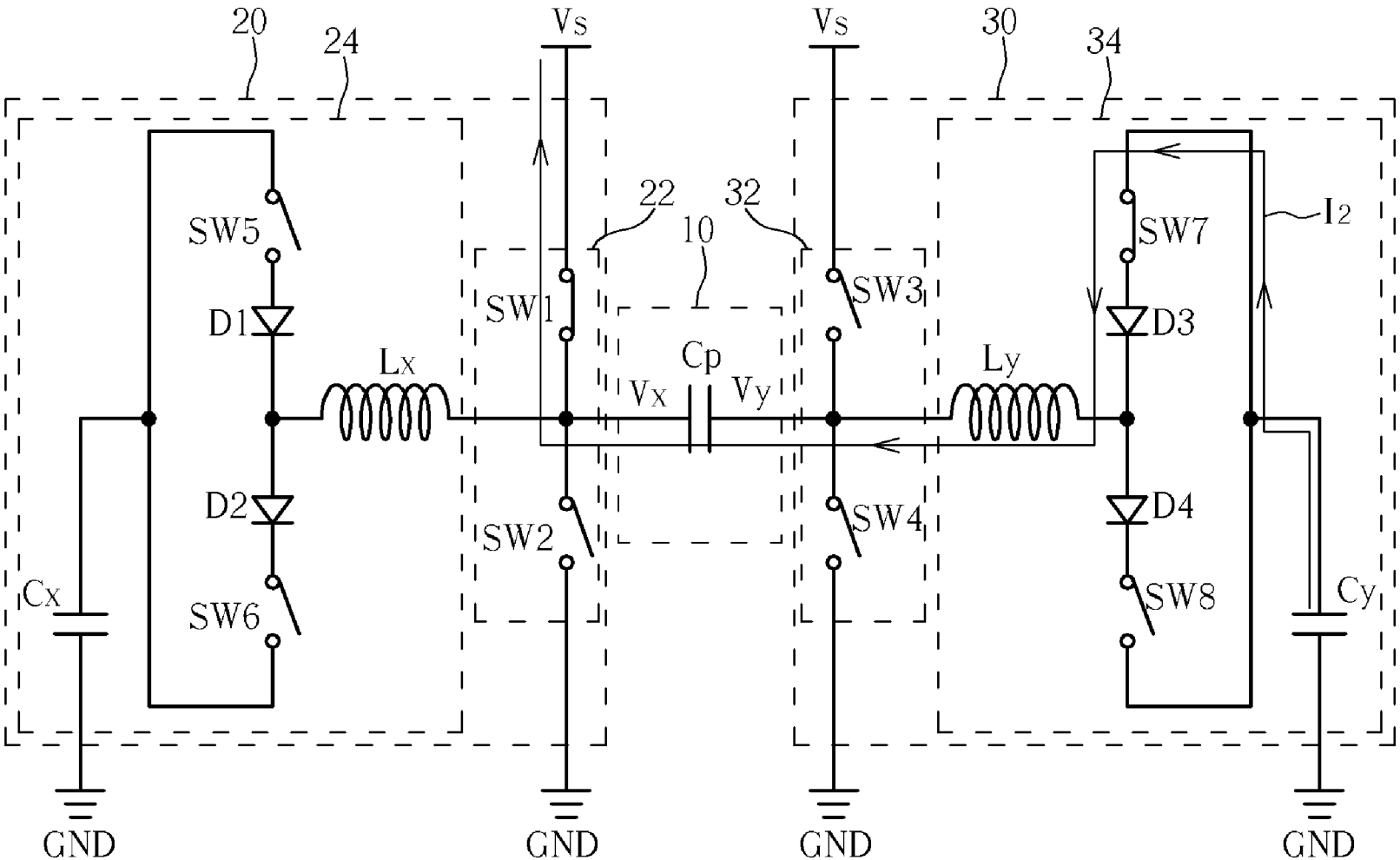
Fig. 3 Prior art
FIG. 3 indicates the status of the drivers shown in FIG. 1 within the period $t_5$-$t_7$ shown in FIG. 2.
Figure 4:
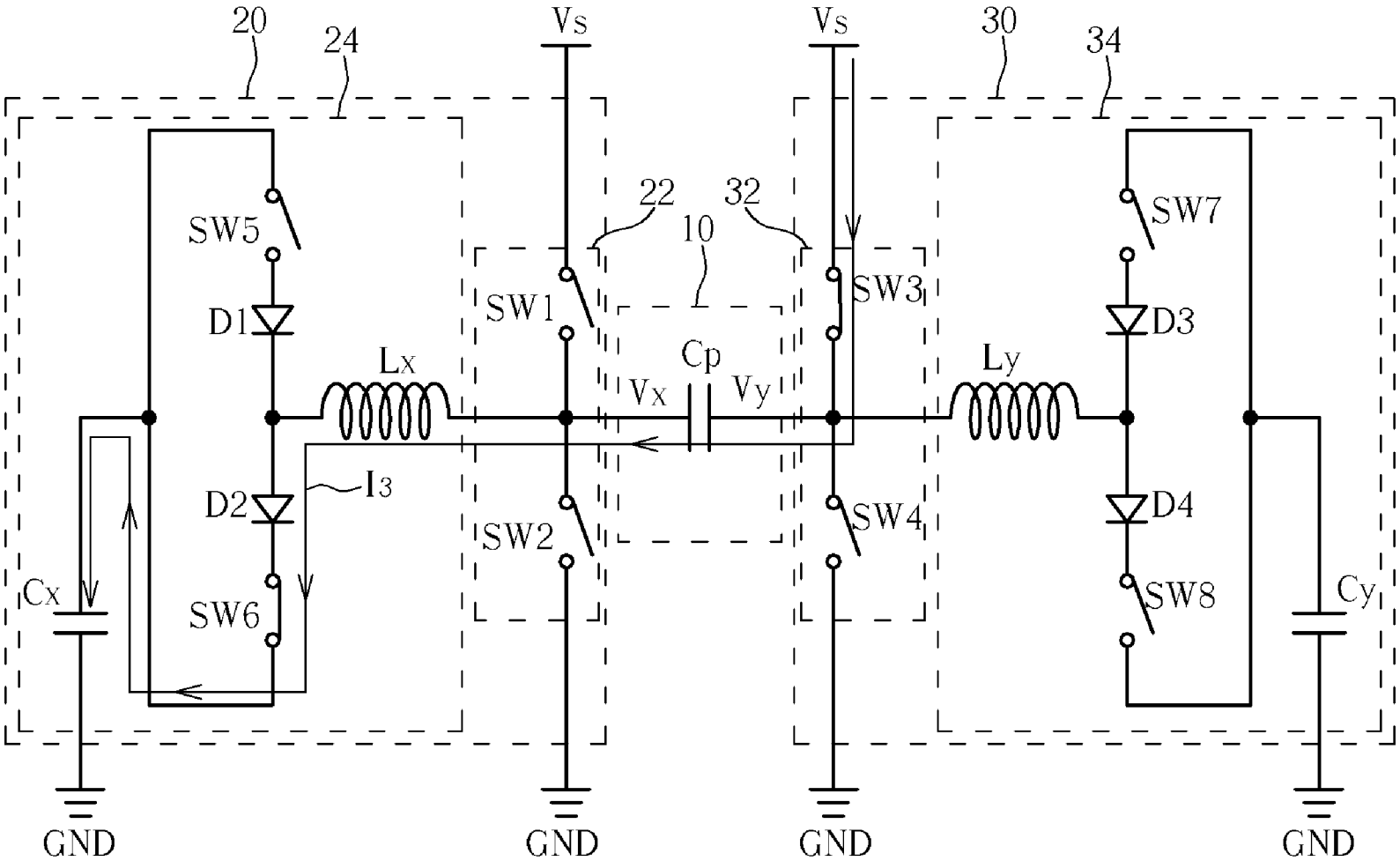
Fig. 4 Prior art
FIG. 4 indicates the status of the drivers shown in FIG. 1 within the period $t_7$-$t_8$ shown in FIG. 2.
Figure 5:
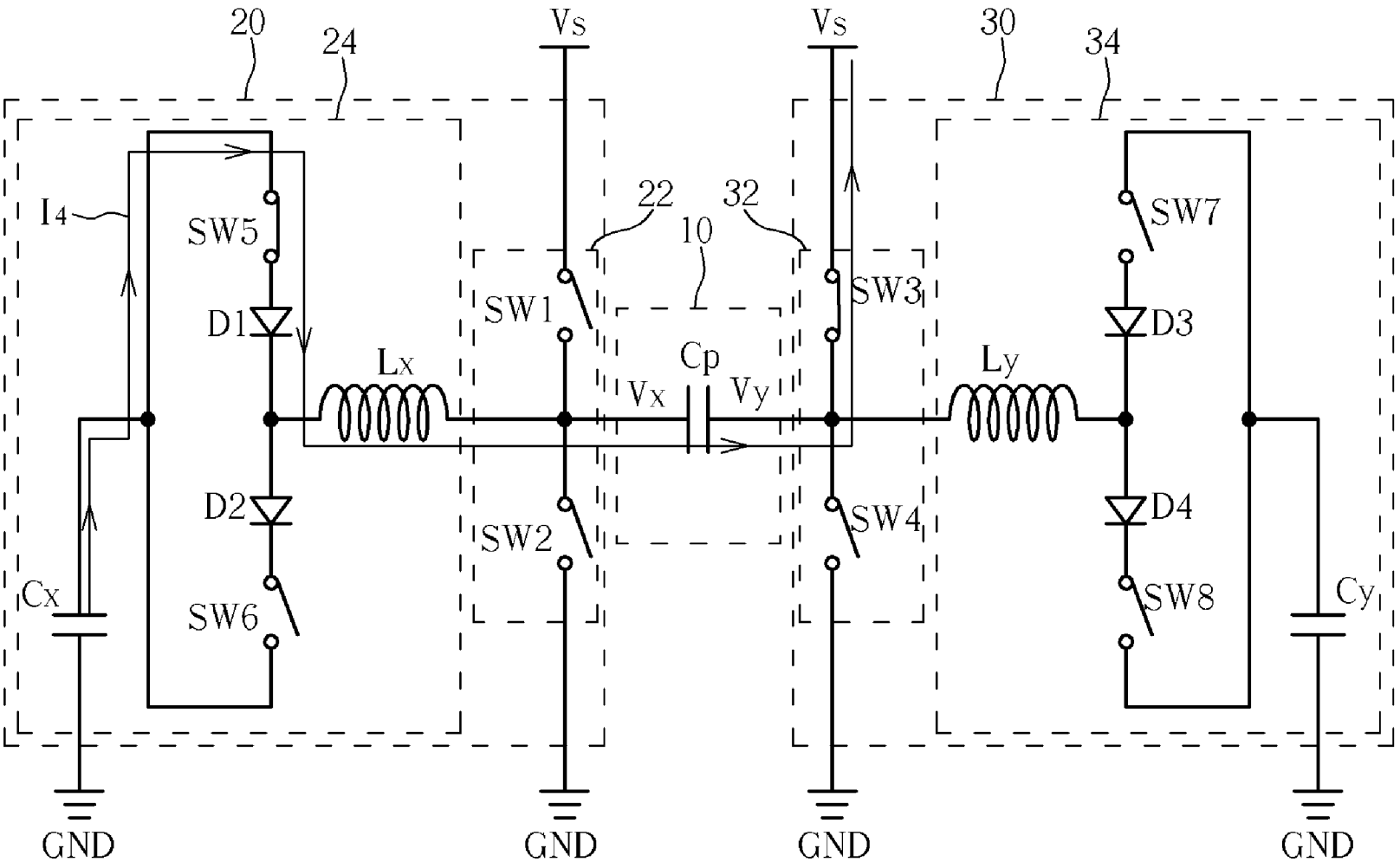
Fig. 5 Prior art
FIG. 5 indicates the status of the drivers shown in FIG. 1 within the period $t_1$-$t_3$ shown in FIG. 2.

Within the period $t_1$-$t_2$, the drivers 20 and 30 are driven similar to the prior art within the period $t_1$-$t_3$ shown in FIG. 2 and the switches SW3 and SW5 are turned on, as shown in FIG. 5, to form the series resonance loop $l_4$ in order to recover the energy stored in the first recovery capacitor Cx in the previous working period to the panel capacitor Cp. Within the period $t_2$-$t_3$, the drivers 20 and 30 are driven as shown in FIG. 7 and the switches SW5 and SW8 are turned on to form a series resonance loop $l_5$ so that the first recovery capacitor Cx charges the second recovery capacitor Cy through the panel 10. Within the period $t_3$-$t_4$, the drivers 20 and 30 are driven similar to the prior art within the period $t_3$-$t_4$ shown in FIG. 2 and the switches SW1 and SW8 are turned on, as shown in FIG. 1, to form the series resonance loop $l_1$ so that the second recovery capacitor Cy is charged again by the panel capacitor Cp. Within the period $t_5$-$t_6$, the drivers 20 and 30 are driven similar to the prior art within the period $t_5$-$t_7$ shown in FIG. 2 and the switches SW1 and SW7 are turned on, as shown in FIG. 3, to form the series resonance loop $l_2$ to recover the energy stored in the second recovery capacitor Cy to the panel capacitor Cp. Within the period $t_6$-$t_7$, the drivers 20 and 30 are driven as shown in FIG. 8 and the switches SW6 and SW7 are turned on to form a series resonance loop $l_6$ so that the second recovery capacitor Cy charges the first recovery capacitor Cx through the panel 10. Within the period $t_7$-$t_8$, the drivers 20 and 30 are driven similar to the prior art within the period $t_7$-$t_8$ shown in FIG. 2 and the switches SW3 and SW6 are turned on, as shown in FIG. 4, to form the series resonance loop $l_3$ so that the first recovery capacitor Cx is charged again by the panel capacitor Cp.

When the panel capacitor Cp charges the first recovery capacitors Cx or the second recovery capacitor Cy, the high-frequency capacitance effect, the inductance effect, and the resistance effect make the voltage variation of the first recovery capacitor Cx or the second recovery capacitor Cy equal to (Vs/2−ΔV1), i.e. less than Vs/2. However, because of the formation of the series resonance loops $l_5$ and $l_6$, both the first recovery capacitor Cx and the second recovery capacitor Cy are respectively charged twice within a working period of the PDP. Therefore, after charge, the voltage gap between the two ends of each recovery capacitor Cx or Cy is greater than (Vs/2−ΔV1). Moreover, because the voltage gap between the two ends of each recovery capacitor Cx or Cy is greater than (Vs/2−ΔV1), the voltage Vx or Vy should be greater than (Vs−2ΔV1), i.e. approximately equal to the sustain voltage Vs, after the energy stored in the recovery capacitor Cx or Cy is recovered to the panel capacitor Cp. Hence, when the switch SW1 or SW3 are turned on to connect one of the electrodes of the panel capacitor Cp to the first bias terminal Vs, the voltage variation of the voltage Vx or Vy is reduced or even vanished so that zero-voltage switching can be achieved.

In contrast to the prior art, the present invention provides a method to charge the two recovery capacitors twice respectively so that the voltage level of one of the electrodes of the panel capacitor can be approximately equal to the sustain voltage before the electrode connects to the first bias terminal Vs. Therefore, the power consumption of the plasma display panel can be reduced.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for reducing power consumption of a plasma display panel (PDP), the PDP comprising a first switch selectively allowing electrical charges to flow from a first voltage source to a first terminal of the PDP, a second switch selectively allowing electrical charges to flow from the first terminal of the PDP to ground, a third switch selectively allowing electrical charges to flow from a second voltage source to a second terminal of the PDP, a fourth switch selectively allowing electrical charges to flow from the second terminal of the PDP to ground, a first recovery capacitor with a first terminal coupled to ground, a fifth switch selectively allowing electrical charges to flow from a second terminal of the first recovery capacitor to the first terminal of the PDP, a sixth switch selectively allowing electrical charges to flow from the first terminal of the PDP to the second terminal of the first recovery capacitor, a second recovery capacitor with a first terminal coupled to ground, a seventh switch selectively allowing electrical charges to flow from a second terminal of the second recovery capacitor to the second terminal of the PDP, and an eighth switch selectively allowing electrical charges to flow from the second terminal of the PDP to the second terminal of the first recovery capacitor;

the method comprising:

turning on the second switch and turning off the first, third, fourth, fifth, sixth, seventh, and eighth switches for a first period;

turning on the third and fifth switches and turning off the first, second, fourth, sixth, seventh, and eighth switches for a second period;

turning on the fifth and eighth switches and turning off the first, second, third, fourth, sixth, and seventh switches for a third period; and turning on the first, fifth, and eighth switches and turning off the second, third, fourth, sixth, and seventh switches for a fourth period.

2. The method of claim 1 wherein the first, second, third, and fourth periods are sequential with the first period occurring before the second period, the second period occurring before the third period, and the third period occurring before the fourth period.

3. The method of claim 2 further comprising:

turning on the first and seventh switches and turning off the second, third, fourth, fifth, sixth, and eighth switches for a fifth period after the fourth period.

4. The method of claim 3 further comprising:

turning on the sixth and seventh switches and turning off the first, second, third, fourth, fifth, and eighth switches for a sixth period after the fifth period.

5. The method of claim 4 further comprising:

turning on the third, sixth, and seventh switches and turning off the first, second, fourth, fifth, and eighth switches for a seventh period after the sixth period.

6. The method of claim 5 further comprising:

turning on the second and sixth switches and turning off the first, third, fourth, fifth, seventh and eighth switches for an eighth period after the seventh period.

* * * * *